US008888452B2

(12) United States Patent
Richardson

(10) Patent No.: US 8,888,452 B2
(45) Date of Patent: Nov. 18, 2014

(54) SHROUD FOR ROTATING MACHINE COMPONENT

(75) Inventor: Jason Scot Richardson, Chuckey, TN (US)

(73) Assignee: Parker Hannifin Corporation, Cleveland, OH (US)

( * ) Notice: Subject to any disclaimer, the term of this patent is extended or adjusted under 35 U.S.C. 154(b) by 988 days.

(21) Appl. No.: 12/980,684

(22) Filed: Dec. 29, 2010

(65) Prior Publication Data

US 2011/0189019 A1 Aug. 4, 2011

Related U.S. Application Data

(60) Provisional application No. 61/300,217, filed on Feb. 1, 2010.

(51) Int. Cl.
*F04D 29/40* (2006.01)
*F04D 29/42* (2006.01)

(52) U.S. Cl.
CPC ..... *F04D 29/42* (2013.01)
USPC ..... 415/214.1; 416/244 R

(58) Field of Classification Search
CPC ..... F04D 29/42; F04D 29/40; F04D 29/52; F04D 29/70; F04D 29/701; F04D 29/703
USPC ..... 415/214.1, 223; 416/244 R, 181, 247 R; 361/695, 679.48, 679.51
See application file for complete search history.

(56) References Cited

U.S. PATENT DOCUMENTS

| | | | | |
|---|---|---|---|---|
| 1,877,285 | A | 9/1931 | Eckels | |
| 2,314,696 | A | 3/1942 | Funk | |
| 2,622,793 | A | 12/1952 | Ganger et al. | |
| 2,667,301 | A | 1/1954 | Lautner | |
| 3,073,976 | A | 1/1963 | Wesolowski | |
| 3,411,296 | A | 11/1968 | Peterson | |
| 3,779,341 | A | 12/1973 | Huggins | |
| 3,791,148 | A | 2/1974 | Alcock et al. | |
| 4,120,615 | A | 10/1978 | Keem et al. | |
| 4,335,646 | A | 6/1982 | Jacquet et al. | |
| 5,498,130 | A | 3/1996 | Wakley et al. | |
| 5,623,893 | A | 4/1997 | Bartz et al. | |
| 5,628,206 | A | 5/1997 | Baba | |
| 5,960,748 | A | 10/1999 | Lewis | |
| 5,997,254 | A * | 12/1999 | Tosaki | 416/247 R |
| 6,022,200 | A | 2/2000 | Myers | |
| 6,036,444 | A | 3/2000 | Barney et al. | |
| 6,045,330 | A | 4/2000 | Williams | |
| 6,692,240 | B1 | 2/2004 | Leonhard et al. | |
| 6,772,824 | B1 | 8/2004 | Tsuruta | |
| 2005/0220637 | A1 | 10/2005 | Kopel et al. | |

* cited by examiner

*Primary Examiner* — Dwayne J White
(74) *Attorney, Agent, or Firm* — Robert J. Clark

(57) ABSTRACT

A shroud 10 is carried by a housing 14 of a hydraulic machine 12. The shroud 10 at least partially encloses a rotating fan 74 disposed on a rotating shaft 72 that extends from the housing. The shroud 10 includes a mounting portion 22 having a peripheral mounting wall 50 that encircles the housing 14 with an interference fit and that includes tapered slots 60 for receiving tapered cooling fins 62 of the housing 14. The shroud 10 also includes a shroud portion 20 formed of integral one piece construction with the mounting portion. The shroud portion 20 includes a peripheral shroud wall 30 and a perforated shroud cover wall 38. The shroud portion 20 is arranged in cantilever relation to the mounting portion 22. A stop member 40, 44 engages a rotating end of the shaft 72 to limit deflection of the cantilevered shroud member toward the fan 74.

17 Claims, 8 Drawing Sheets

SHROUD FOR ROTATING MACHINE COMPONENT

CROSS REFERENCE TO RELATED APPLICATIONS

The present application claims the benefit of the filing date of U.S. Provisional Patent Application Ser. No. 61300217, filed Feb. 1, 2010, the disclosure of which is incorporated herein by reference in its entirety.

TECHNICAL FIELD

This invention relates to a shroud for enclosing a rotating component of a machine. More particularly, this invention relates to an air flow shroud for enclosing a rotating cooling fan blade of a hydraulic machine.

BACKGROUND OF THE INVENTION

Shrouds may be used to partially or fully enclose various articles, in order to cover, screen and/or guard those components. Shrouds may be commonly used to enclose rotating machine components, including air flow fans.

Machines, such as hydraulic machines, may produce or otherwise be subjected to high heat during operation. In order to help dissipate the heat, the machines may include a cooling fan for forcing air across a housing of the machine. The cooling fan may be affixed to a shaft of the machine and rotate with rotation of the shaft. It may be desirable, in some instances, to provide a shroud over the fan that would limit access to the fan while permitting air flow through the shroud. One such shroud is disclosed in U.S. Patent Application Publication No. 2005/0220637.

SUMMARY OF THE INVENTION

The present invention provides a shroud that may be used in a wide variety of applications to at least partially enclose rotating machine components. The rotating machine component may include a rotating component carried by a machine housing, and the rotating component may carry an air flow fan for cooling the housing.

The shroud may include a mounting portion and a shroud portion. The mounting portion may include a mounting wall having a mounting surface for being secured to the housing. The shroud portion may include an enclosing portion for at least partially enclosing the rotating component. A stop member carried by the enclosing portion may engage a central end face of the rotating component to support the shroud portion and limit deflection of the shroud portion in a direction toward the rotating component.

The shroud portion and the stop member may be movable between an at rest position in which the stop member is spaced from the rotating component and a deflected position in which the stop member engages the rotating component to limit deflection movement of the shroud portion away from its at rest position and toward the rotating component. The mounting portion may be stationary relative to the housing, and the shroud portion may be movable between the at rest position and the deflected position relative to the mounting portion. The mounting portion and the shroud portion may be of integral one piece construction.

The shroud portion may include a shroud peripheral wall extending around the rotating member and a perforated cover wall attached to the peripheral wall for covering a rotating end of the rotating member. The mounting wall may include a plurality of tapered slots for engaging tapered fins on the housing and at least one compressible ridge for engaging the housing and biasing the tapered slots toward the tapered fins. The mounting wall may be is a continuous uninterrupted wall, and the shroud portion may be disposed in cantilevered relationship to the mounting portion with a portion of the mounting wall forming a portion of the shroud wall. The tapered slots may be carried on the portion of the mounting wall that forms a portion of the shroud wall.

The shroud peripheral wall may extend around the fan, and the perforated cover wall may extend over the fan with the stop axially aligned with the rotating end of the rotating component. The stop and the rotating end may be in nested concentric relationship. The housing is a portion of a hydraulic machine.

The invention also provides various ones of the additional features and structures described in the claims set out below, alone and in combination, which claims are incorporated by reference in this summary of the invention.

BRIEF DESCRIPTION OF THE DRAWINGS

Embodiments of this invention will now be described in further detail with reference to the accompanying drawings, in which.

DETAILED DESCRIPTION OF THE INVENTION

The principles, embodiments and operation of the present invention are shown in the accompanying drawings and described in detail herein. These drawings and this description are not to be construed as being limited to the particular illustrative forms of the invention disclosed. It will thus become apparent to those skilled in the art that various modifications of the embodiments herein can be made without departing from the spirit or scope of the invention.

Figure 8:
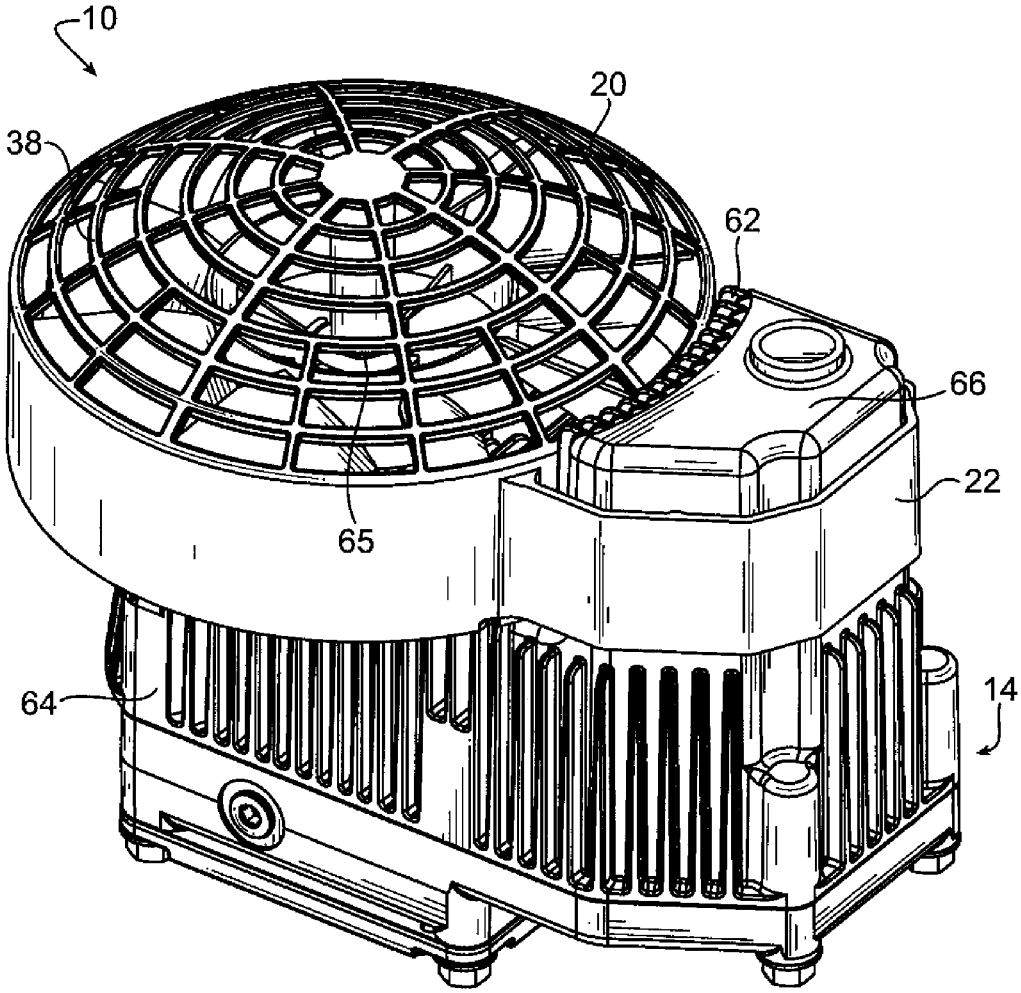
FIG. 8 is a perspective view, similar to FIG. 2, but showing the shroud in combination with a machine.
Figure 9:
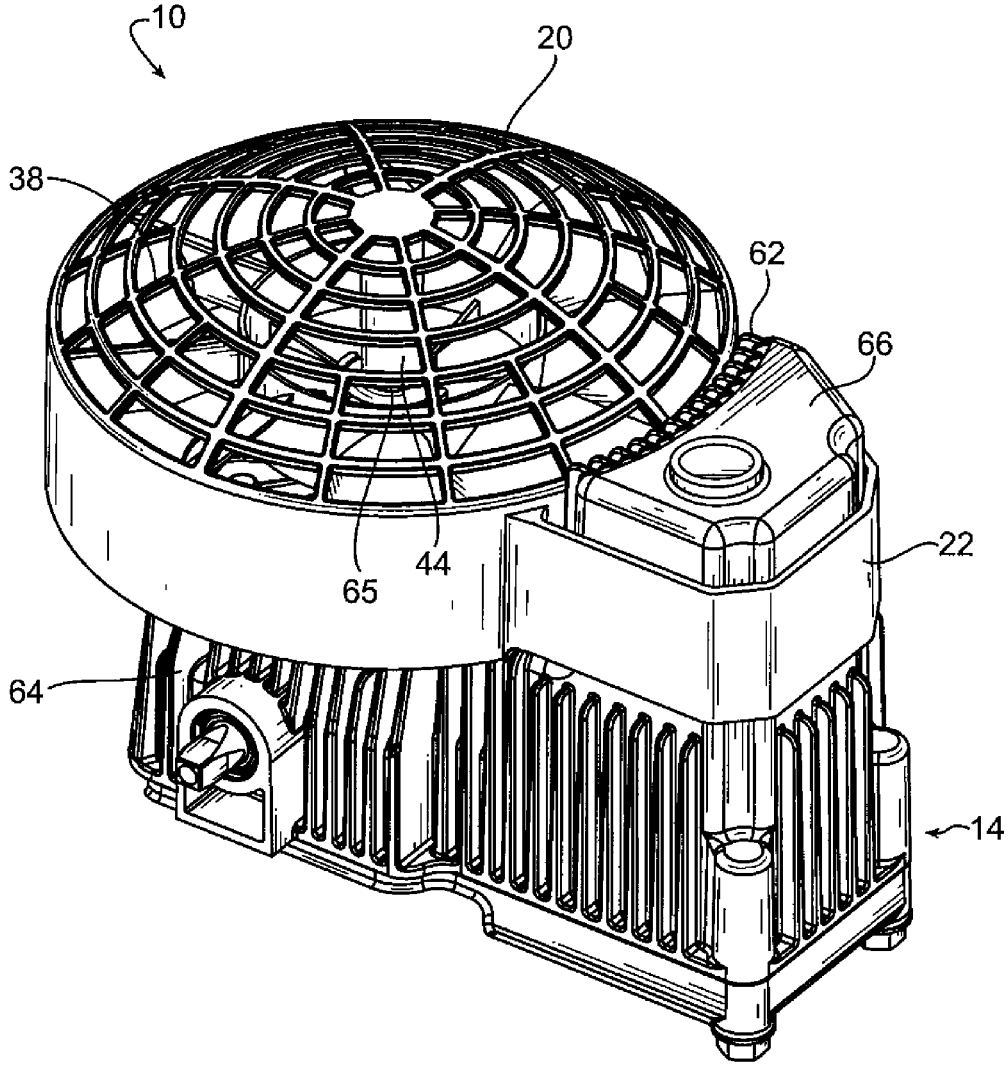
FIG. 9 is a view similar to FIG. 8, but showing a modification of the shroud and machine.
Figure 10:
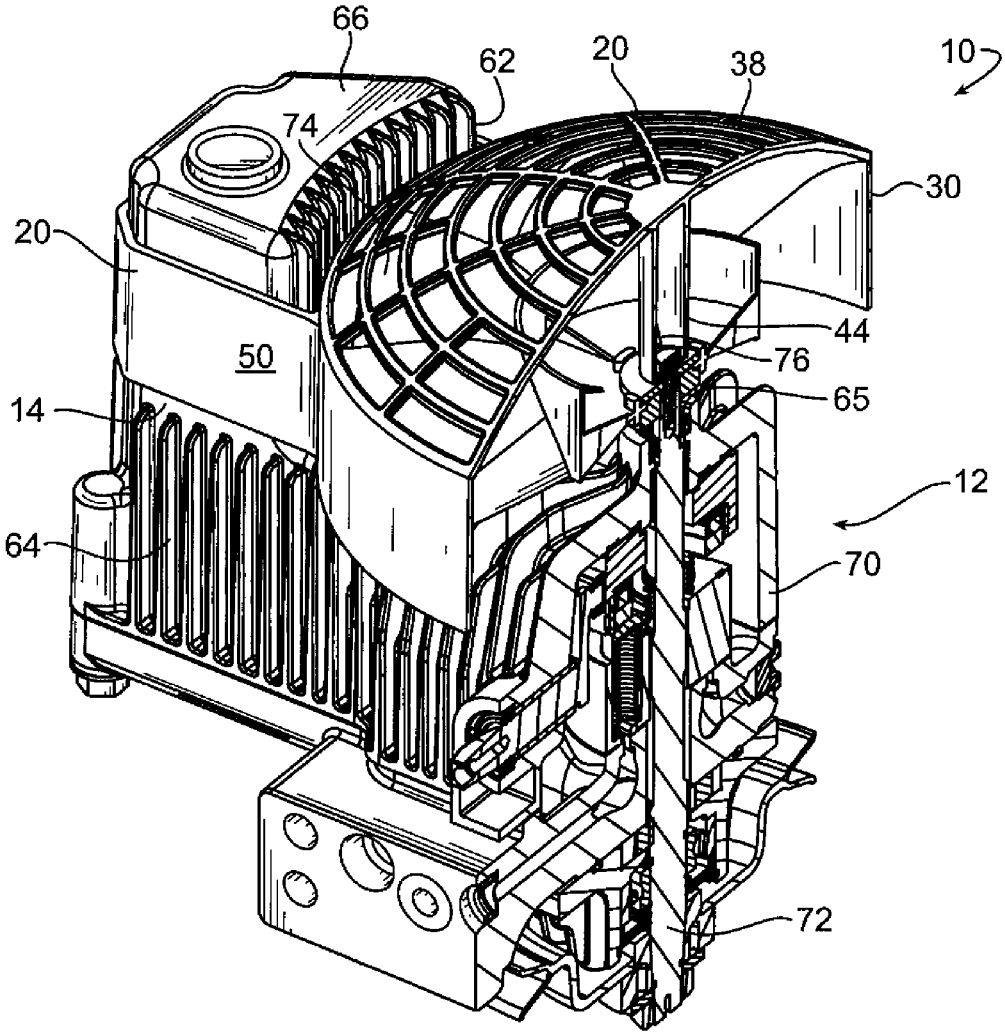
FIG. 10 is a partial cross section of FIG. 8.

Referring now to the drawings in greater detail, FIGS. 1-7 illustrate various views of an exemplary embodiment of a shroud 10 constructed in accordance with the present invention, for use in association with a rotating component of a machine. FIGS. 8 and 9 illustrate a housing 14 of a machine with the shroud 10 attached to the housing 14. FIG. 10 illustrates a perspective, sectional view of an exemplary machine 12, in this example an integrated hydrostatic transmission, and the shroud 10 is attached to the housing 14 of the machine 12. It should be noted that the machine 12 may be a hydraulic machine such as a hydraulic pump, a hydraulic motor, a hydraulic pump/motor, an integrated hydrostatic transmission or any other type of hydraulic machine. Also, the hydraulic machine 12 need not include the specific housing 14 as illustrated in FIGS. 8-10 as the shroud 10 of the present invention may be adapted to attach to nearly any housing component of a machine.

With reference to FIGS. 1-7, the shroud 10 includes a shroud portion 20 and a mounting portion 22. The shroud portion 20 includes a central longitudinal axis 24 and a generally cylindrical shroud peripheral wall 30 having an upper end 32 and a lower end 33. The shroud 10 also includes a meshed or perforated shroud cover wall 38 that extends inwardly from the upper end 32 of peripheral wall 30 to a central shroud support hub 40 disposed along the axis 24. The shroud portion peripheral wall 30 and the shroud cover wall 38 provide an enclosing structure for at least partially enclosing a rotating component of the machine 12 in a manner more fully explained below. The perforated shroud cover wall 38 is a rounded dome shape, to discourage foreign objects from remaining on the wall. The openings in the perforated cover wall 38 may be dimensioned and arranged according to industry standards, such as American National Standards Institute B71.4-2004. These standards may require in certain applications that shrouds for rotating machine components prevent ingress of certain size human fingers and withstand certain loads. The central support hub or stop member 40 is located a spaced distance longitudinally above the upper end 32 of the peripheral wall 30. The support hub 40 includes an elongated cylindrical shroud support hub or stop member extension 44 that extends axially downwardly from the central support hub 40 and terminates in a location along the central axis 24 of the peripheral wall 30 between the upper and lower ends 32 and 33.

The mounting portion 22 of the shroud 10 extends outwardly from the peripheral wall 30 and has a profile which is substantially similar to a profile of a corresponding portion of the housing 14 of the associated hydraulic machine 12. The mounting portion 22 is adapted to receive the corresponding housing portion and to form a stationary friction fit against an outer surface of the corresponding housing portion. The mounting portion 22 illustrated includes a mounting peripheral wall 50 that has a central longitudinal axis 51 parallel to the central axis 24 of the shroud portion 12. The mounting wall 50 extends longitudinally between upper and lower mounting ends 52 and 54. The axial length of the mounting wall 50 of the mounting portion 22 when measured between its upper and lower ends 52 and 54 is slightly less than the axial length of the shroud wall 30 of the shroud portion 22 when measured between its upper and lower ends 32 and 33. The shroud peripheral wall 30 and the mounting peripheral wall 50 together define a FIG. 8 shape, in which the shroud peripheral wall 30 forms one loop of the 8 and the mounting peripheral wall 50 forms another loop of the 8 and a wall portion 55 forms a common wall of both the shroud wall 30 and the mounting wall 50.

Figure 1:
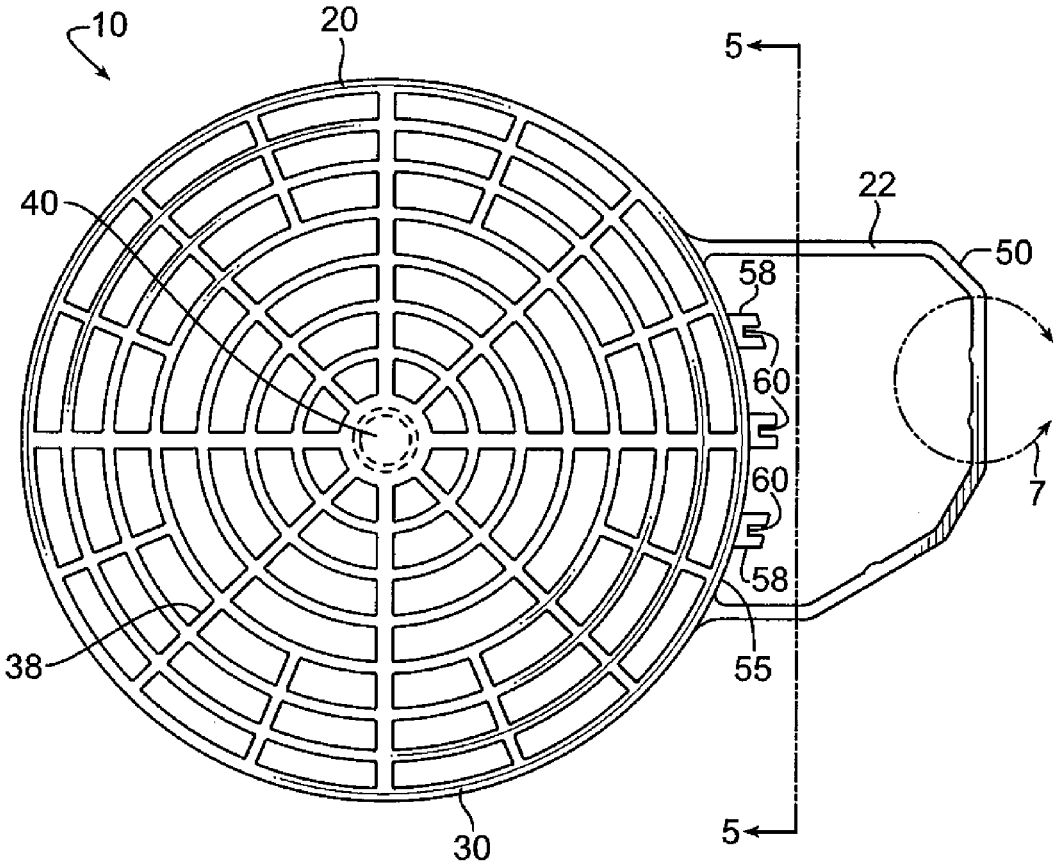
FIG. 1 is a top elevation view of a preferred embodiment of the present invention.
Figure 2:
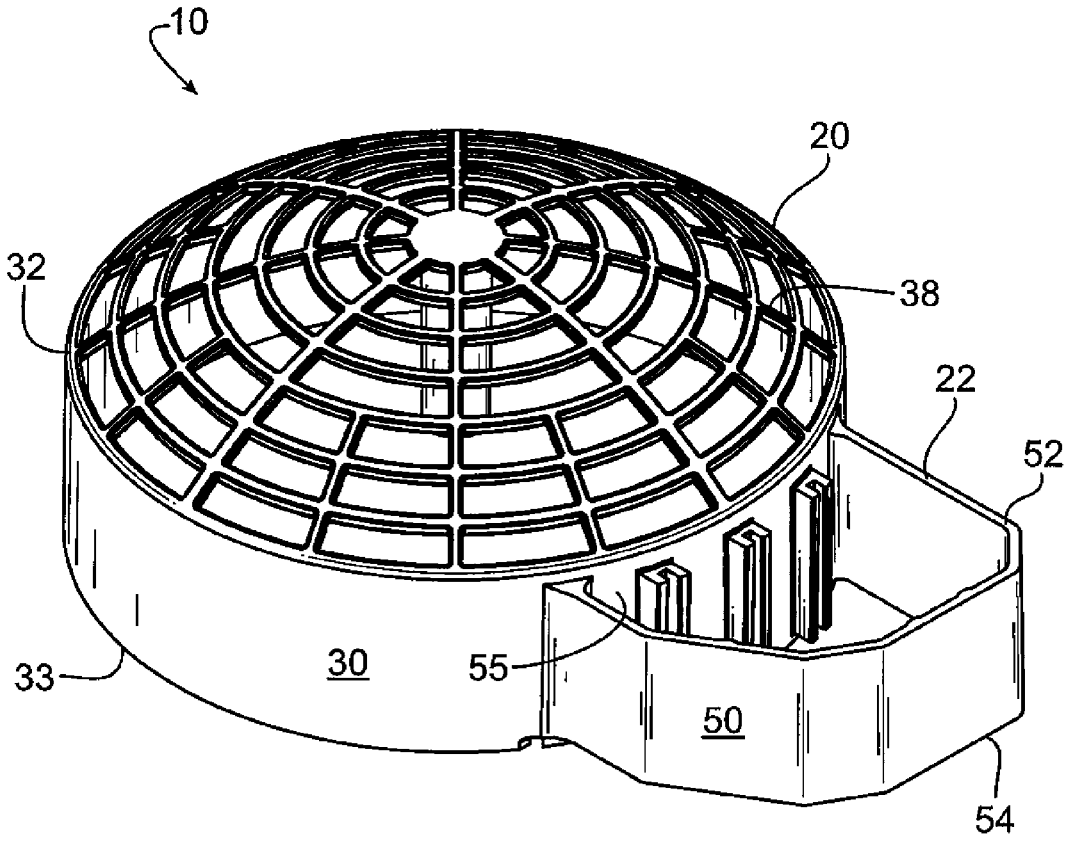
FIG. 2 is a perspective view of the shroud shown in FIG. 1.
Figure 3:
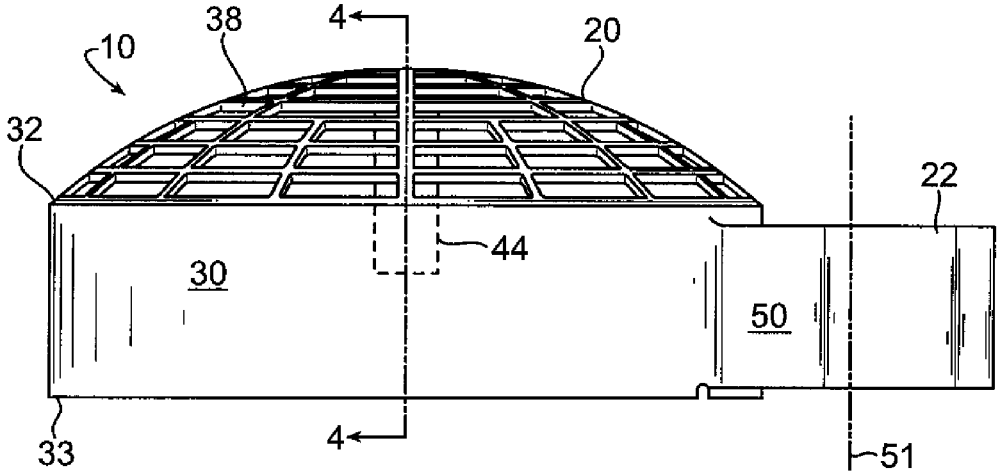
FIG. 3 is a side elevation view of the shroud shown in FIGS. 1 and 2.
Figure 4:
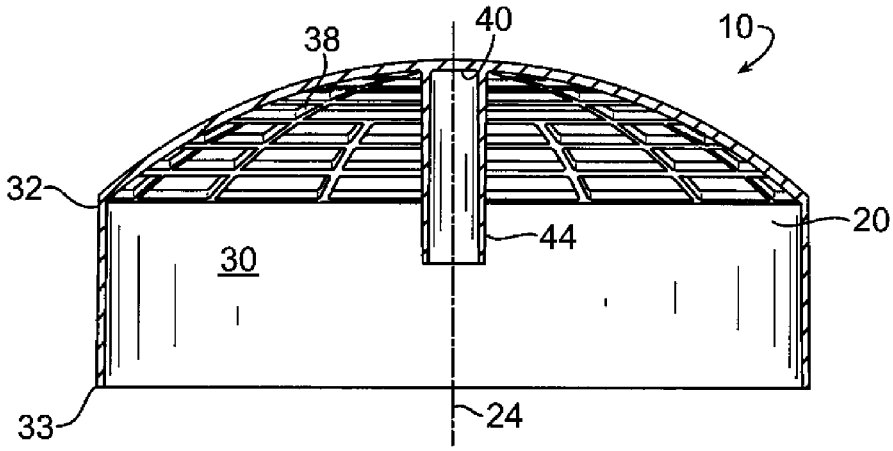
FIG. 4 is a cross section view taken along reference view line 4-4 in FIG. 3.
Figure 5:
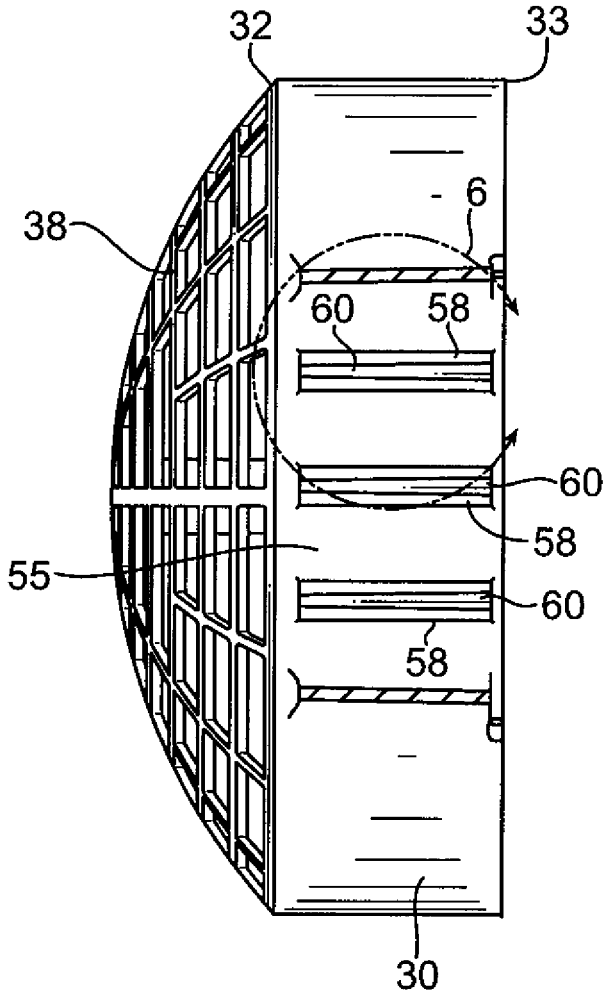
FIG. 5 is a view taken along reference view line 5-5 in FIG. 1.
Figure 6:
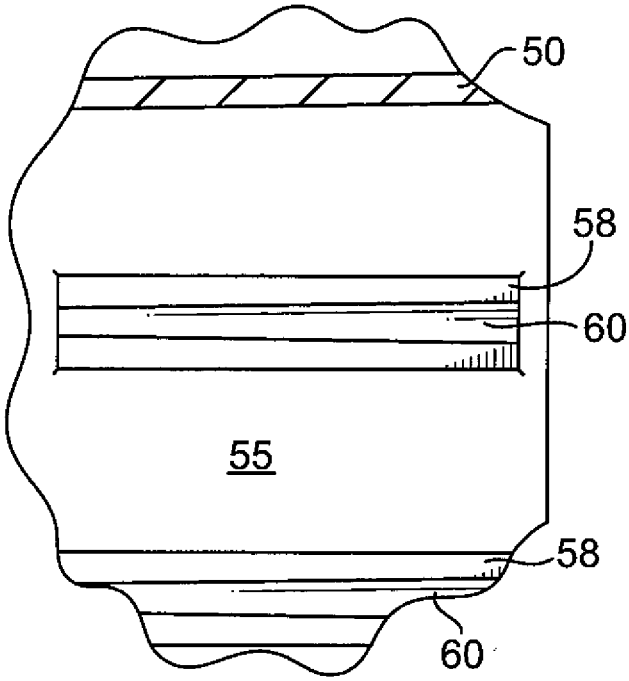
FIG. 6 is an enlarged view of the portion of FIG. 5 illustrated as detail 6.
Figure 7:
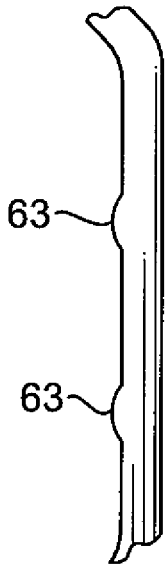
FIG. 7 is an enlarged view of the portion of FIG. 1 illustrated as detail 7.

The common wall 55 of the shroud 10 may include slotted attachment members 58 that face toward the axis 51 of the mounting portion 22 and away from the axis 24 of the shroud portion 20. FIGS. 1, 2 and 5 illustrate three (3) slotted attachment members 58 located on the common wall 55. The slotted members 58 extend longitudinally in a direction parallel to the central axes 51 and 24 and are open in a radial direction facing the axis 51. Each slotted member 58 defines an elongated slot 60 that is sized for receiving a cooling fin 62 or other projection from the housing 14 of the hydraulic machine 12. The cooling fins 62 are slightly tapered, so that the free end of each fin is of slightly smaller width than the base end of each fin. The elongated slots 60 are also slightly tapered, with the same taper angle as that of the fins 62. Since the tapers of the fins 62 and slots 60 are equal, the mounting portion 22 is not biased away from the fins 62. The remainder of the mounting peripheral wall 50 encircles the housing 14 with an interference fit. Radial projections 63 formed integrally in the inside surface of the mounting peripheral wall 50 opposite the slots 60 extend axially for substantially the entire axial extent of the peripheral wall 50. The projections 63 are slightly compressed when the shroud 10 is mounted on the housing 14 and exert a constant tensioning force to retain the slots 60 in place against the fins 62 without slipping or movement even under conditions of significant vibration.

FIGS. 8-10 illustrate the shroud 10 assembled on the housing 14, with the hydraulic machine 12 assembled in the housing 14. The housing 14 includes a first housing portion 64 having a through-hole 65 in its upper surface through which a rotating shaft 72 of the hydraulic machine 12 extends and an adjacent upwardly extending housing portion 66 that forms, in this example, a portion of an oil reservoir having a fill port. In the illustrated example, the upwardly extending portion 66 of the housing 14 is received in the peripheral wall 50 of the mounting portion 22 of the shroud 10 such that the wall 50 of the mounting portion 22 forms a friction or interference fit against the outer surface of the upwardly extending portion 66 of the housing 14, assisted by the radial projections 63. The mounting portion 22 of the shroud 10 is mounted on the housing 14 and held against movement relative to the housing 14, while the shroud portion 20 of the shroud 10 is disposed in a cantilevered relationship to the mounting portion 22 and arranged for cantilevered deflecting movement relative to the mounting portion 22 in a manner more fully discussed below. When the mounting portion 22 receives the upwardly extending portion 66 of the housing 14, the elongated support hub 40 with its support hub extension 44 of the shroud portion 20 of the fan shroud 10 is axially aligned with and spaced an axial distance from and located above the through-hole 65 and the shaft 72 that extends through portion 64 of the housing 14.

FIG. 10 illustrates a perspective sectional view of a portion of an integrated hydrostatic transmission that includes the housing 14, a hydraulic pump 70 and a hydraulic motor (not shown). FIG. 10 illustrates the rotating input shaft 72 of the pump 70, and the longitudinal axis of the shaft 72 is coaxial with the axis 24 of the shroud portion 20. The rotating component includes a cooling fan 74, a portion of which is illustrated in FIG. 10, carried by the shaft 72 and fixed to the shaft 72 for rotation with the shaft 72. As shown in FIG. 10, the hydraulic pump 70 is an axial piston pump that includes a plurality of pistons that are reciprocal within a rotating cylinder barrel. Rotation of the input shaft 72 of the pump 70 results in reciprocal movement of the pistons to generate fluid power and results in rotation of the cooling fan 74 to pull air through the perforated shroud cover wall 38 and across the housing 14 beneath the shroud 10 for cooling purposes.

FIG. 10 also illustrates the shroud 10 attached to the housing 14 of the integrated hydrostatic transmission machine 12. When attached to the housing 14, the cylindrical support hub extension 44 of the support hub 40 of the shroud portion 22 of the shroud 10 is coaxially aligned with the shaft 72 and fan 74. As best shown in FIG. 10, the support hub extension 44 includes a blind end bore 76 extending axially from its free end. The surfaces of the blind end bore 76 receive but are both axially and radially spaced slightly away from the rotating terminal end of the shaft 72, so that the shaft 72 may rotate relative to the shroud 10. In this manner, the shaft 72 and the hub or stop member 40, 44 are arranged in a coaxial nested relationship. Thus, when the fan shroud 10 is attached to the hydraulic machine 12, in this case the integrated hydrostatic transmission 12, the fan shroud 10 is supported by the mounting portion 22 which in turn is carried by the portion 66 of the housing 14. In this relaxed or normal position, the support hub extension 44 is axially aligned with and axially spaced apart from the rotating terminal end of the shaft 72. When a sufficient load is placed on the shroud portion 20 of the shroud 10 in an axial direction toward the rotating shaft 72 and fan 74, the shroud portion 20 deflects axially relative to the stationary mounting portion 22 in a direction toward the rotating terminal end of the shaft 72 and fan 74. When the shroud portion 20 is moved to this displaced position, the support hub extension 44 engages the rotating terminal end of the shaft 72 and fan 74. This engagement limits further axial deflection of the shroud portion 20 relative to the supporting portion 22 and provides an auxiliary support to maintain the perforated shroud cover wall 38 a distance away from the fan 74.

The air flow shroud 10, including the shroud portion 20 and the mounting portion 22, is preferably integrally formed from a thermoplastic material and is injection molded as one monolithic structure. A presently preferred material for the shroud 10 is a glass filled nylon material. The mounting portion 22 may have alternative profiles necessary for receiving a corresponding portion of the housing 14 of the hydraulic machine 12. The fan shroud 10 thus may be installed on the hydraulic machine 12 without the use of fasteners or clips and may be held in place merely by a friction interference fit relative to the housing 14 of the hydraulic machine 12 when in its at rest position and additionally by the auxiliary support provided by the hub extension 44 engaging the rotating member 72, 74 when in a deflected position.

One application for the hydrostatic transmission 12 may be with drive wheels of motorized vehicles such as lawn mowers. In such applications, one unit 12 may drive a right side wheel of the mower and another unit 12 may drive a left side wheel of the mower. As illustrated in FIGS. 8 and 9, the machines 12 may have a slightly different housing configuration for the right and left sides of the mower. Also, the perforations and thickness of the shroud wall 38 may be varied for different applications for the hydraulic machines 12 and shroud 10.

As an alternative embodiment to the fan shroud illustrated in the drawings, the mounting portion of the fan shroud may extend downwardly from the shroud portion for engaging a portion of the housing located beneath the fan. In such a construction, the mounting portion may include an angled portion that narrows from the outer wall of the shroud portion to a dimension approximately equal to an outer dimension of the housing and then, also may include an engagement portion for engaging the housing. In such a construction, however, the area of engagement between the housing and the mounting portion of the fan shroud ideally is kept to a minimum to ensure that heat dissipated through the housing is carried away by the fan.

Presently preferred embodiments of the invention are shown in the drawings and described in detail above. The invention is not, however, limited to these specific embodiments. Various changes and modifications can be made to this invention without departing from its teachings, and the scope of this invention is defined by the claims set out below.

What is claimed is:

1. A shroud for at least partially enclosing a rotating component of a machine having a housing from which the rotating component extends, the shroud comprising:

a mounting portion, the mounting portion including a mounting surface for being secured to the housing; and a shroud portion, the shroud portion including an enclosing portion for at least partially enclosing the rotating component, and a stop member carried by the enclosing portion for engaging a central end face of the rotating component to limit deflection of the stop member and the shroud portion in a direction toward the rotating component;

wherein the shroud portion and stop member are movable between an at rest position in which the stop member is spaced from the rotating component and a deflected position in which the stop member engages the rotating component to limit deflection movement of the shroud portion away from its at rest position and toward the rotating component.

2. A shroud as set forth in claim 1, wherein the mounting portion is stationary and the shroud portion is movable between the at rest position and the deflected position relative to the mounting portion.

3. A shroud as set forth in claim 2, wherein the mounting portion includes a mounting wall portion for being secured to the housing.

4. A shroud as set forth in claim 3, wherein the mounting wall portion includes a plurality of tapered slots for engaging tapered fins on the housing.

5. A shroud as set forth in claim 4, wherein the mounting wall portion includes at least one compressible ridge for engaging the housing and biasing the tapered slots toward the tapered fins.

6. A shroud as set forth in claim 3, wherein the mounting wall portion is a continuous uninterrupted wall.

7. A shroud as set forth in claim 1, wherein the mounting portion and the shroud portion are of integral one piece construction.

8. A shroud as set forth in claim 7, wherein the shroud portion is disposed in cantilevered relationship to the mounting portion.

9. A shroud as set forth in claim 8, wherein the shroud portion includes a shroud peripheral wall for extending around the rotating member and a perforated cover all attached to the peripheral wall for covering a rotating end of the rotating member, and a portion of the mounting wall portion forms a portion of the shroud peripheral wall portion.

10. A shroud as set forth in claim 9, wherein the stop member is carried by the perforated cover wall.

11. A shroud as set forth in claim 1, wherein the shroud is in combination with a housing and rotating member extending from the housing.

12. A shroud as set forth in claim 11, wherein the rotating component carries an air flow fan, the shroud peripheral wall extends around the fan, the perforated cover wall extends over the fan, the stop is axially aligned with the rotating end of the rotating component, and the stop and the rotating end are disposed in coaxial nested relationship.

13. A shroud as set forth in claim 12, wherein the housing is a portion of a hydraulic machine.

14. A shroud for at least partially enclosing a rotating component of a machine having a housing from which the rotating component extends, the shroud comprising:

a mounting portion, the mounting portion including a stationary mounting surface for being secured to the housing; and a movable shroud portion, the movable shroud portion being affixed in cantilever relationship to the mounting portion, the shroud portion including an enclosing portion for at least partially enclosing the rotating component, and a stop member carried by the enclosing portion for engaging another portion of the machine to limit deflection of the stop member and the shroud portion; and wherein the mounting portion and said shroud portion are of integral construction.

15. A shroud as set forth in claim 14, wherein the other portion of the machine is an end face of the rotating component.

16. A shroud as set forth in claim 15, in combination with the machine, wherein the stop member and the rotating component are coaxially disposed.

17. A shroud as set forth in claim 14, wherein the shroud mounting surface includes one side of a continuous shroud mounting wall encircling a portion of the housing, the shroud portion includes a shroud peripheral wall for extending around the rotating member and a perforated cover wall attached to the peripheral wall for covering a rotating end of the rotating member, a portion of the mounting wall portion forms a portion of the shroud peripheral wall portion, the stop member is carried by the perforated cover wall, the rotating component carries an air flow fan, the shroud peripheral wall extends around the fan, the perforated cover wall extends over the fan, the stop is axially aligned with the rotating end of the rotating component, and the stop includes a bore into which an end of the rotating member project.

* * * * *